United States Patent [19]

Iwata

[11] Patent Number: 4,742,892

[45] Date of Patent: May 10, 1988

[54] CONTROL APPARATUS FOR ELEVATOR

[75] Inventor: Shigemi Iwata, Inazawa, Japan

[73] Assignee: Mitsubishi Denki Kabushiki Kaisha, Japan

[21] Appl. No.: 22,870

[22] Filed: Mar. 6, 1987

[30] Foreign Application Priority Data

Mar. 7, 1986 [JP] Japan ..... 61-49670

[51] Int. Cl.[4] ..... B66B 1/30

[52] U.S. Cl. ..... 187/119

[58] Field of Search ..... 187/116, 119

[56] References Cited

U.S. PATENT DOCUMENTS 4,483,419 11/1984 Salihi et al. ..... 187/119

4,600,088 7/1986 Yonemoto ..... 187/119

4,625,834 12/1986 Tanahashi ..... 187/119

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

In an elevator control system employing a variable-voltage and variable-frequency control, a control apparatus having limiter for limiting the maximum value of a slip frequency $\omega_s$ when the frequency $\omega_0$ of current command values to be delivered to an inverter circuit for operating an induction motor is evaluated in accordance with a condition formula of $\omega_0=\omega_s+\omega_4$ (where $\omega_r$ denotes the angular rotational frequency of the induction motor), whereby an actual car speed can be limited to a safe low value even when the detected car speed is erroneous due to a malfunction of the car speed detection device. Also, the time period during which the generated slip frequency command signal exceeds a reference value is measured to determine the current frequency command signal for the induction motor.

4 Claims, 5 Drawing Sheets

FIG. 7 (a) PRIOR ART
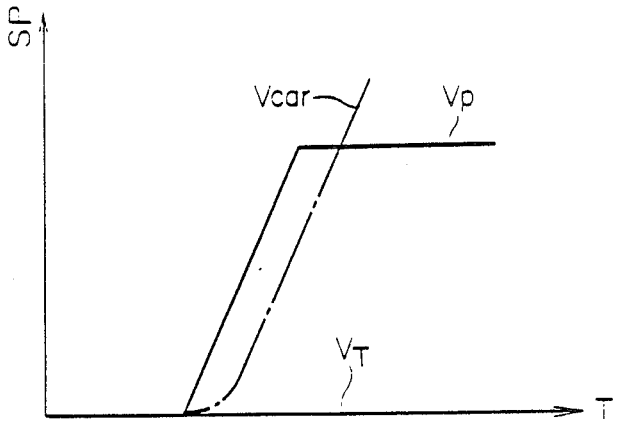
FIG. 7 (b) PRIOR ART
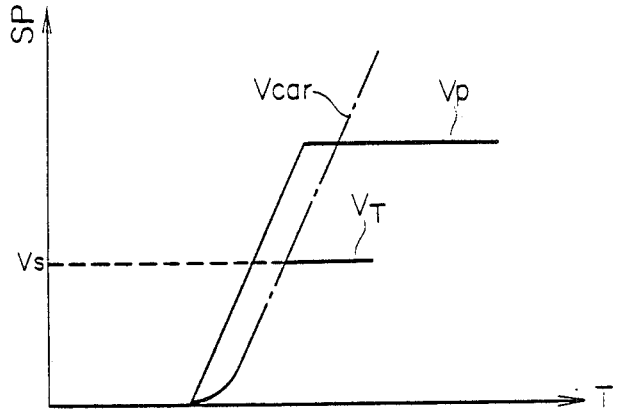

CONTROL APPARATUS FOR ELEVATOR

BACKGROUND OF THE INVENTION

This invention relates to a control apparatus for controlling the speed of the car of an elevator, and more particularly to a control apparatus which can limit the car speed to a safe operating level at all times.

In order to operate an elevator car with a good riding quality and with a high floor arrival accuracy, the rotation of an electric motor must be controlled precisely and smoothly. To achieve this objective recent technological progress in microelectronics and power electronics has been applied to elevator systems.

FIG. 5 is a system arrangement diagram showing a control apparatus for an elevator of this type. Referring to the figure, numeral 5 designates a car, numeral 6 a rope, numeral 7 a sheave, numeral 8 a counterweight, and numeral 9 a three-phase induction motor. A pulse generator 10 produces pulses corresponding to the revolution speed of the motor 9, and a counter circuit 11 counts the number of output pulses of the pulse generator 10. A microcomputer 12 is constructed of an input port 121 which forms an interface for receiving a signal from the counter circuit 11, a central processing unit (hereinbelow, termed "CPU") 122, a ROM 123, a RAM 124, an output port 125 which forms an interface for delivering a signal 131 to a power converter circuit 13, and a bus 126. Shown at numeral 14 is a three-phase A.C. power source.

Besides, FIG. 6 is a block diagram showing the function of a feedback control based on the microcomputer 12. A compensator 1 performs phase and gain compensations on the basis of the input of the error $\epsilon$ between a speed reference signal $V_P$ and a car speed signal $V_T$, and delivers an output $V_C$. It has a transfer function $G_C(S)$ where S denotes the Laplace operator. Numeral 4 indicates a converter by which the angular rotational frequency $\omega_r$ of the three-phase induction motor 9, obtained on the basis of the output of the counter circuit 11 received via the input port 121, is converted into the car speed signal $V_T(V_T=K_T\cdot\omega_r$ where $K_T$ denotes a coefficient), and the car speed signal $V_T$ is delivered as an output. Numeral 130 indicates calculation means for converting the output $V_C$ of the compensator 1 into the command value 131 for the power converter circuit 13.

In the control apparatus having the above construction, the pulses corresponding to the rotational frequency of the three-phase induction motor 9 are generated by the pulse generator 10 and are counted by the counter circuit 11, and the count value is transferred to the microcomputer 12. Then, the microcomputer 12 converts the count value into a car speed so as to calculate the car speed signal $V_T$. Subsequently, it performs the feedback control on the basis of the error $\epsilon$ between the predetermined speed reference signal $V_P$ and the car speed signal $V_T$ and delivers the command value 131 to the power converter circuit 13. Electric power controlled with this command value is applied to the three-phase induction motor 9, and the speed of the car 5 of the elevator is controlled. That is, the construction of FIGS. 5 and 6 carries out the feedback control by the use of the speed reference signal $V_P$ and the car speed signal $V_T$, thereby intending to control the speed of the car precisely and smoothly.

With the above construction, however, in a case where the car speed signal $V_T$ presents a value lower than an actual car speed $V_{car}$ on account of the trouble of the pulse generator 10, the counter circuit 11, the input port 121 or the like, the error $\epsilon(=V_P-V_T)$ becomes a large value, which, in turn, produces a substantial change in the speed of the car 5, and the car 5 runs recklessly to expose passengers in the car to danger. Such situations are illustrated in FIGS. 7(*a*) and 7(*b*). FIG. 7(*a*) corresponds to the case of a fault which occurs when the car speed signal $V_T$ indicates a zero i.e., when the car 5 stops, while the actual car speed $V_{car}$ steadily rises. On the other hand, FIG. 7(*b*) corresponds to the case of a fault which occurs when the car speed signal $V_T$ is clipped to $V_S$ (i.e., after the start of the running of the car 5) while the actual car speed $V_{car}$ steadily rises. In both cases, the car speed signal $V_T$ indicates a value lower than the actual car speed $V_{car}$, and the car speed $V_{car}$ continues to be increased, that is, the car 5 continues to be accelerated. The difference $(V_P-V_T)$ is increased, causing an error in the command value B1 delivered to the power converter circuit 13 to operate the induction motor 9. As a result, the elevator car runs irresponsively. Finally, a governor (not shown) which is a safety device for preventing an overspeed is operated to stop the car 5. This sudden halt, with the passengers confined in the car, is very dangerous. This drawback is attributed to the fact that the prior-art construction performs the feedback control with the error $\epsilon$ between the speed reference signal $V_P$ and the car speed signal $V_T$, thereby to control the torque of the three-phase induction motor 9. For the purpose of avoiding this drawback, it is considered, by way of example, to utilize a double-checked generation means including a pair of pulse generators and a pair of counter circuits for double-checking the rationality of the car speed signal. This measure, however, results in a very expensive and complicated system.

SUMMARY OF THE INVENTION

This invention the objective of eliminating the problems stated above and has for its more specific object to provide a control apparatus for an elevator which can always limit the speed of a car to a safe speed even when the output of detection means for a car speed signal is lower than an actual car speed.

The control apparatus for an elevator according to this invention takes the form of a variable-voltage and variable-frequency control incorporated into a power converter circuit for a three-phase induction motor so as to limit a slip frequency corresponding to the error between a speed reference signal and a car speed signal and to deliver the value of the sum between the slip frequency and the angular rotational frequency of the three-phase induction motor as a current frequency command value for the three-phase induction motor.

In this invention, an upper limit value is set for the slip frequency, and the frequency command value of the three-phase induction motor is suppressed low, so that even when a car speed detected is lower than an actual car speed, the actual car speed can be limited to a safe value.

BRIEF DESCRIPTION OF THE DRAWINGS

FIGS. 7(*a*) and 7(*b*) are characteristic diagrams of the prior-art example corresponding to FIGS. 3(*a*) and 3(*b*) respectively.

DESCRIPTION OF THE PREFERRED EMBODIMENTS

Figure 1:
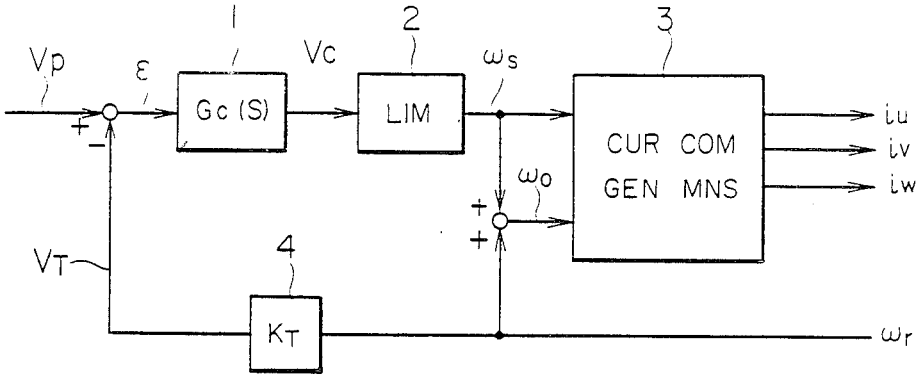
FIG. 1 is a functional block diagram showing an embodiment of this invention.
Figure 5:
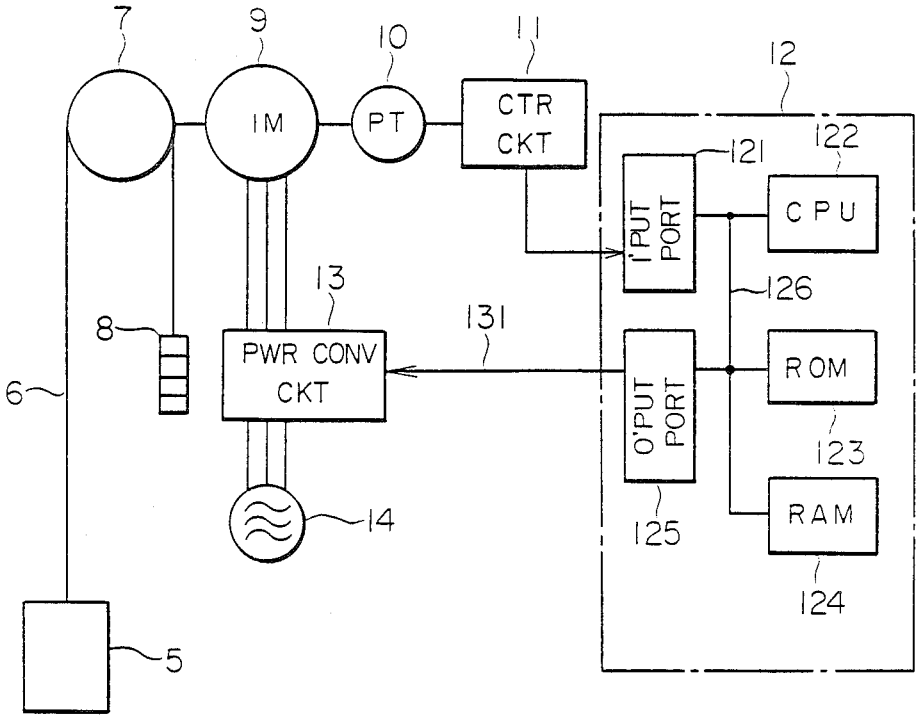
FIG. 5 is a hardware architecture diagram showing a control apparatus for an elevator.
Figure 6:
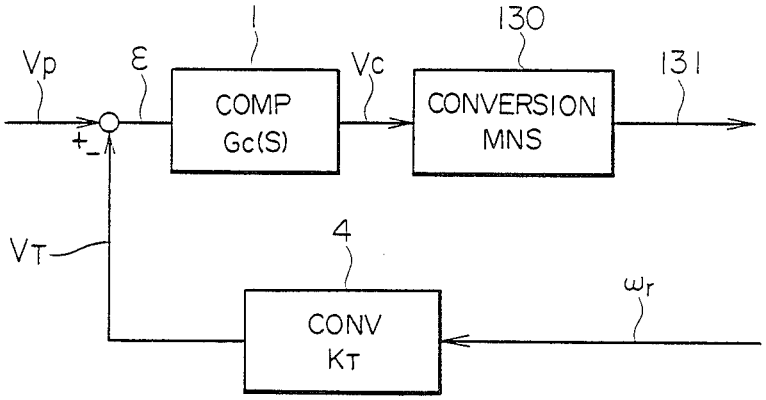
FIG. 6 PRIOR ART
FIG. 6 is a functional block diagram of a prior-art example corresponding to FIG. 1.

Now, an embodiment of this invention will be described with reference to a functional block diagram (FIG. 1) corresponding to the arrangement of FIG. 6 in the prior-art example. In FIG. 1, the same symbols as in FIG. 6 indicate identical portions, which shall be omitted from the description. Referring to FIG. 1, numeral 2 designates a limiter, and numeral 3 current command generation means for calculating the amplitudes and phases of current command values $i_u$, $i_v$ and $i_w$ from the output $\omega_s$ of the limiter 2. Symbol $\omega_0$ denotes the frequency of the current command values $i_u$, $i_v$ and $i_w$ for the three-phase induction motor 9. The output $\omega_s$ of the limiter 2 is a slip frequency. In this invention, it is assumed that the power converter circuit 13 in the arrangement of FIG. 5, which receives the aforementioned current command values, be composed of a converter circuit for converting the three-phase alternating current of the power source 14 into direct current and an inverter circuit for inverting the direct current into alternating current. It is also assumed that the signal 131 indicative of the current command values $i_u$, $i_v$ and $i_w$ be used for controlling the inverter circuit.

Meanwhile, such a converter circuit and an inverter circuit have recently come into use for the speed control of the three-phase induction motor 9. The control of current command values to be actually delivered to the inverter circuit has been extensively known on the basis of the theories of a vector control etc. (refer to, for example, Uchino, Kurosawa and Ōnishi: "Vector Control of Induction Machine," Instrumentation and Control, 356/362, No. 2, Vol. 22 (1978).

In this embodiment, the current command values $i_u$, $i_v$ and $i_w$ from the current command generation means 3 are given by the following equations:

$$i_u = i_1 \cos(\omega_0 t + \theta_{01})$$

$$i_v = i_1 \cos\left(\omega_0 t + \theta_{01} - \frac{2\pi}{3}\right)$$

$$i_w = i_1 \cos\left(\omega_0 t + \theta_{01} - \frac{4\pi}{3}\right)$$

where $\omega_0 = \omega_s + \omega_r$ holds, $i_1$ denotes the amplitude of the current command values, and $\theta_{01}$ denotes the inverse tangent value of the ratio between a torque component current and a magnetic flux component current obtained from $\omega_s$.

Figure 2:
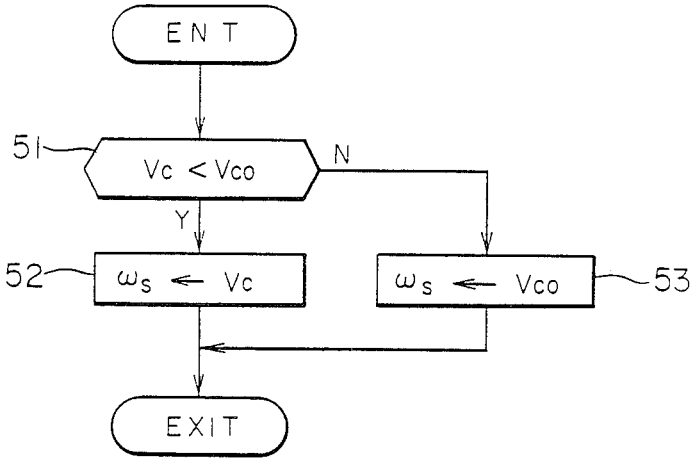
FIG. 2 is a flow chart for explaining a function in FIG. 1.

FIG. 2 is a flow chart in which the limiter 2 shown in FIG. 1 is materialized by a program. This program is set in the ROM 123 within the microcomputer 12 in FIG. 5. It is assumed that the functional block diagram of FIG. 1 be entirely realized by the microcomputer 12 which operates according to a predetermined program.

Referring to the program of FIG. 2, a step 51 compares the output $V_C$ of the compensator 1 with a limit value $V_{C0}$. Subject to a "Yes" upon deciding that $V_C < V_{C0}$, the control flow proceeds to a step 52, while with a "No," the control flow proceeds to a step 53. In step 52, $V_C$ is used to determine the slip frequency $\omega_s$, while in step 53, the limit value $V_{C0}$ is used. The program is executed, for example, every 10 msec. This program sets the limit value $V_{C0}$ for the output of the compensator 1 and does not produce a slip frequency greater than $V_{C0}$. By the way, the upper limit value $V_{C0}$ may be selected at a value which the output $V_C$ does not reach in the ordinary running of the car of the elevator.

Figure 3:
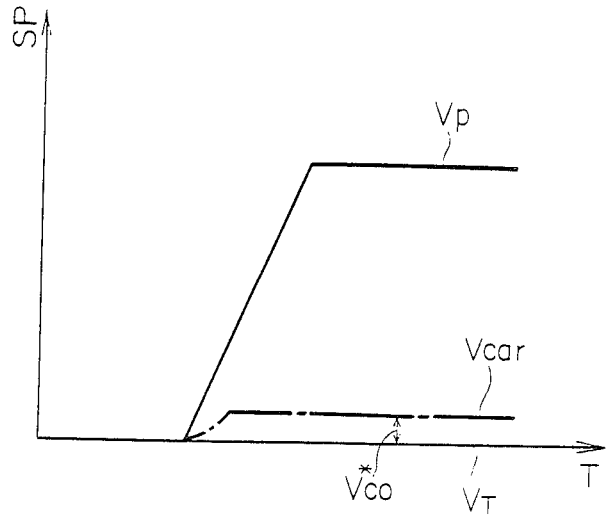
FIGS. 3(*a*) and 3(*b*) are characteristic diagrams for explaining the effect of the embodiment.
Figure 3:
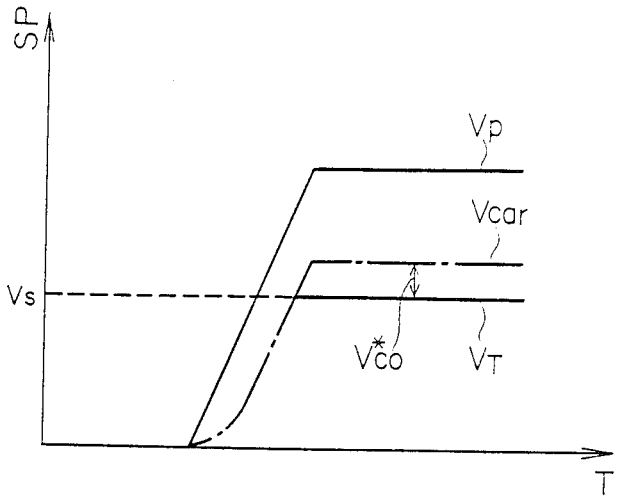

According to the above construction, an effect achieved by the limiter 2 in FIG. 1 can be acknowledged as seen from FIGS. 3(*a*) and 3(*b*). FIGS. 3(*a*) and 3(*b*) are similar to FIGS. 7(*a*) and 7(*b*) of the prior-art example, respectively. More specifically, FIG. 3(*a*) illustrates the case of the fault which occurs when the car speed signal $V_T$ indicates a zero i.e., when the car 5 stops and FIG. 3(*b*) illustrates the case of the fault which occurs when the car speed signal $V_T$ is clipped to $V_S$ after the start of the running of the car 5. In addition, $V_{C0}^*$ denotes a calculated car speed value in the case where the compensator output $V_C$ is clipped to the maximum value $V_{C0}$ by the operation of the limiter 2. In both cases, the faults are such that the car speed signal $V_T$ presents a value lower than the actual car speed $V_{car}$. It is supposed by way of example that $V_T=0$ and $V_T<V_S$ hold in FIG. 3(*a*) and FIG. 3(*b*), respectively, on account of the trouble of the pulse generator 10, counter circuit 11 or input port 21. In the fault of FIG. 3(*a*), the speed reference signal $V_P$ begins to rise with the start of the running of the car and reaches a rated speed value in due course. Herein, since the car speed $V_T$ is zero at all times, the error $\epsilon$ in FIG. 1 becomes a large value, with the result that the output $V_C$ of the compensator 1 becomes a large value. Since, however, the limiter 2 is configured as illustrated by the flow chart of FIG. 2, the slip frequency $\omega_S$ has its maximum value suppressed to $V_{C0}$. Accordingly, the command frequency $\omega_0$ of the current command values $i_u$, $i_v$ and $i_w$ becomes:

$$\omega_0 = V_{C0}$$

This is because $\omega_r=0$ holds due to the trouble. The three-phase induction motor 9 is accordingly rotated at the frequency $V_{C0}$, so that the actual car speed $V_{car}$ is limited to the converted car speed value $V_{C0}^*$ of the frequency $V_{C0}$.

On the other hand, in the fault of FIG. 3(*b*), at first, the car speed signal $V_T$ rises normally as the speed reference signal $V_P$ rises. However, after the signal $V_T$ has reached its clip value $V_S$, $V_T=V_S$ holds. Accordingly, after $V_T=V_S$ has held, the output $V_C$ of the compensator 1 in FIG. 1 becomes a very large value. Therefore, the limiter 2 operates, and the actual car speed $V_{car}$ becomes $V_{car}=V_T+V_{C0}^*$, so that the car speed can be limited.

$V_{C0}$ being the limit value of the limiter 2 may satisfactorily be set at several % of the rated speed. The reason therefor is that the slip frequency $\omega_s$ is ordinarily controlled with values of several % or less relative to the rated speed of the elevator car taken as 100%.

Figure 4:
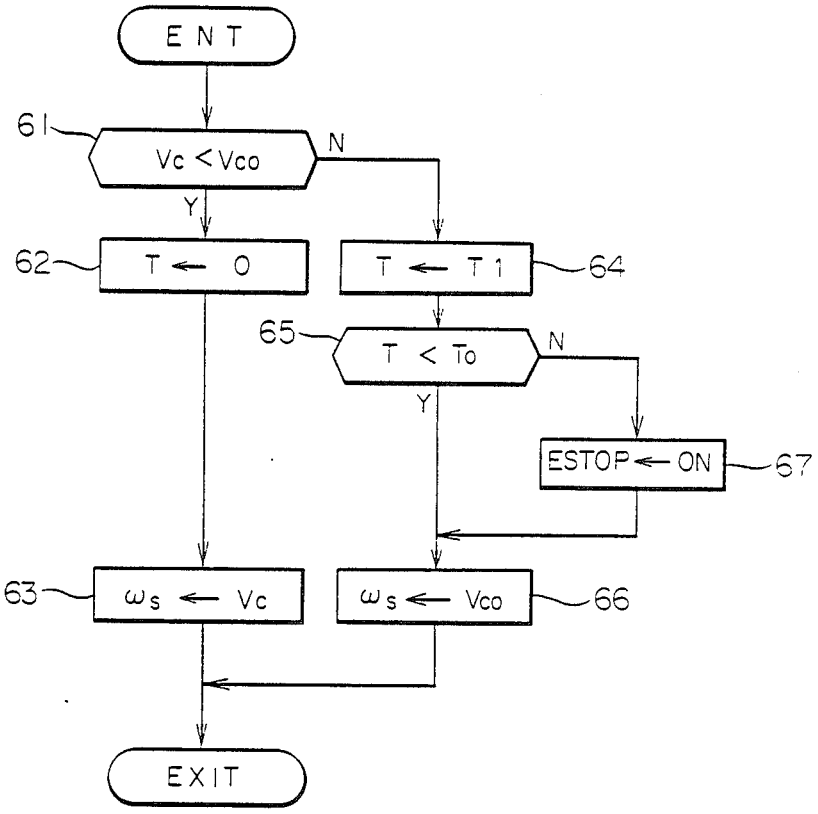
FIG. 4 is a flow chart showing another embodiment for FIG. 2.

Further, FIG. 4 shows another embodiment of this invention. Referring to the figure, a step 61 is followed by a step 62 when the condition of $V_C < V_{C0}$ is "Yes" and by a step 64 when it is "No". At the step 62, a timer T for counting the period of time for which the compensator output $V_C$ exceeds the limiter value $V_{C0}$, is set to zero. Next, $V_C$ is substituted into $\omega_s$ at a step 63. At the step 64, the count value of the timer T is incremented by one. If the timer T is less than a prescribed value $T_0$ at a step 65, the control flow proceeds to a step 66, and if not, the control flow proceeds to a step 67. Further, $V_{C0}$ (the limit value) is substituted into the slip frequency $\omega_s$ at the step 66. At the step 67, an emergency stop command ESTOP for the car is issued, and the car is suddenly stopped according to this command ESTOP. That is, in this embodiment of FIG. 4, the upper limit value $V_{C0}$ is set for the slip frequency $\omega_s$, and the slip frequency is limited to $\omega_s \leqq V_{C0}$ even in the worst case. Moreover, the period of time for which $V_C \leqq V_{C0}$ continues is measured, and when the measured time T has become greater than the prescribed value $T_0$, it is decided that the detection means for the car speed signal $V_T$ has fallen into trouble, and the emergency stop command is delivered to the car. Accordingly, the embodiment is an excellent system which can, not only limit the car speed of the elevator to a safe speed, but also find out the trouble itself.

As described above, according to this invention, in an elevator wherein a car is driven by an induction motor subjected to a variable-voltage and variable-frequency control, limiter means is provided for limiting the maximum value of a slip frequency $\omega_s$ when the frequency $\omega_0$ of current command values to be delivered to an inverter circuit is evaluated in accordance with a condition formula of $\omega_0 = \omega_s + \omega_r$ (where $\omega_r$ denotes the angular rotational frequency of the induction motor), whereby an actual car speed can be limited to a safe low value even when a car speed detection device has developed trouble. Moreover, this construction makes it unnecessary to utilize a double-checked car speed detection means as has hitherto been considered, and it can forcibly limit the actual car speed itself, so that a safe apparatus can be realized inexpensively.

What is claimed is:

1. In an elevator system including an induction motor operated under variable-voltage and variable-frequency control by an inverter and a pulse generator means producing a detected speed signal representing rotational frequency of the induction motor, a control apparatus comprising:

(a) compensation means for generating a compensation signal on the basis of an error between a reference speed signal and the detected speed signal, (b) limit means receiving a compensation signal and producing a slip frequency command signal on the basis of the compensation signal, and comparing the slip frequency command signal with a predetermined reference value so as to provide an output slip frequency command signal with a magnitude not exceeding the reference value, and (c) current command generation means for generating a current frequency command signal to be delivered to the inverter on the basis of the output slip frequency command signal of said limit means and a rotational frequency signal of said motor.

2. A control apparatus for an elevator as defined in claim 1 wherein said limit means produces an output slip frequency command signal equal to the slip frequency command signal when the slip frequency command signal does not exceed the predetermined reference value, and produces an output slip frequency command signal determined by the reference value when the slip frequency command signal exceeds the predetermined reference value.

3. A control apparatus for an elevator as defined in claim 2 wherein said limit means comprises measurement means for measuring a period of time during which the generated slip frequency command signal exceeds the reference value, time comparison means for comparing the measured time period with a predetermined reference time value and for delivering the output slip frequency command signal when the measured time period exceeds the reference time value, and stop signal generation means for generating a signal to stop the elevator when the measured time period does not exceed the reference time value.

4. A control apparatus for an elevator as defined in claim 1 wherein said current command generation means generates the current frequency command signal on the basis of the slip frequency command signal from said limit means and a signal obtained by adding the slip frequency command signal to the detected speed signal representing rotational frequency of said motor.

* * * * *